US009103639B2

(12) United States Patent
Barthelemy et al.

(10) Patent No.: US 9,103,639 B2
(45) Date of Patent: Aug. 11, 2015

(54) IMPACT MARKING DEVICE FOR PRACTICE ROUND AND ROUND EQUIPPED WITH SUCH A DEVICE

(71) Applicant: MBDA FRANCE, Paris (FR)

(72) Inventors: Patrick Barthelemy, Marmagne (FR); Nicolas Sibilaud, Saint-Doulchard (FR); Marc Ferrat, Saint-Doulchard (FR); Laurent Carton, Saint Florent sur cher (FR); Philippe Dubois, Pigny (FR); Hervé Vuillermoz, Bourges (FR)

(73) Assignee: MBDA France, Paris (FR)

( * ) Notice: Subject to any disclaimer, the term of this patent is extended or adjusted under 35 U.S.C. 154(b) by 0 days.

(21) Appl. No.: 14/373,864

(22) PCT Filed: Jan. 30, 2013

(86) PCT No.: PCT/FR2013/000030

§ 371 (c)(1),
(2) Date: Jul. 22, 2014

(87) PCT Pub. No.: WO2013/117830

PCT Pub. Date: Aug. 15, 2013

(65) Prior Publication Data

US 2015/0027335 A1 Jan. 29, 2015

(30) Foreign Application Priority Data

Feb. 8, 2012 (FR) ..... 12 00382

(51) Int. Cl.

| | |
|---|---|
| ***F42B 12/40*** | (2006.01) |
| ***F42B 8/12*** | (2006.01) |
| ***F42B 8/00*** | (2006.01) |

(52) U.S. Cl.
CPC . *F42B 12/40* (2013.01); *F42B 8/00* (2013.01); *F42B 8/12* (2013.01)

(58) Field of Classification Search
CPC ..... F42B 8/00; F42B 8/12; F42B 12/36; F42B 12/40; F42B 12/46; F42B 12/50
USPC ..... 102/444, 445, 498, 502, 512, 513, 529; 476/577
See application file for complete search history.

(56) References Cited

U.S. PATENT DOCUMENTS

| | | | | |
|---|---|---|---|---|
| 3,911,824 | A * | 10/1975 | Barr et al. | 102/502 |
| 4,326,463 | A | 4/1982 | Burke et al. | |
| 5,233,128 | A * | 8/1993 | Lai | 102/511 |
| 5,654,524 | A * | 8/1997 | Saxby | 102/513 |
| 5,791,327 | A * | 8/1998 | Riggs et al. | 124/71 |
| 6,213,024 | B1 * | 4/2001 | Jasper et al. | 102/502 |
| 7,086,337 | B2 * | 8/2006 | Klein | 102/502 |
| 7,526,998 | B2 * | 5/2009 | Vasel et al. | 102/502 |
| 2007/0119329 | A1 * | 5/2007 | Haeselich | 102/498 |
| 2008/0096702 | A1 * | 4/2008 | Martin | 473/581 |
| 2008/0223246 | A1 * | 9/2008 | Dindl et al. | 102/502 |
| 2011/0023744 | A1 | 2/2011 | Endicott, Jr. et al. | |
| 2011/0079164 | A1 | 4/2011 | Broden et al. | |
| 2012/0180686 | A1 * | 7/2012 | Jones et al. | 102/365 |

* cited by examiner

*Primary Examiner* — Bret Hayes
(74) *Attorney, Agent, or Firm* — Reinhart Boerner Van Deuren P.C.

(57) ABSTRACT

According to the invention, the marking device has a shape of revolution and comprises a casing (1) with a conical bottom (8) closed off by an obturator (2), fixed in a sealed manner to said casing (1). Inside said marking device there is a block (15) of compacted marking product.

5 Claims, 2 Drawing Sheets

IMPACT MARKING DEVICE FOR PRACTICE ROUND AND ROUND EQUIPPED WITH SUCH A DEVICE

The present invention relates to a device for marking the point of impact for practice ammunition, and to practice ammunition provided with a marking device of this type.

It is known that, in order to for it to be possible to see the point of impact of practice ammunition on a target, a marker product, such as talc, a luminescent powder or any other powder or granular product is placed in said ammunition, which marker product is intended to be transported and then dispersed upon impact. A marker product of this type is contained in a hollow receptacle in said ammunition which is capable of rupturing upon impact, so that said marker product disperses, allowing the point of impact to be identified. For example, U.S. Pat. No. 4,326,463 provides that a hollow, breakable tip is produced, which contains said marker product and is capable of being connected to the tip of said projectile.

Using this known practice ammunition, a dose of marker product is predetermined for completely filling said hollow receptacle. Therefore, said marker product undergoes low and indeterminate compaction and only results in said dose being matched to the volume of said hollow receptacle. The compactness of the product inside said receptacle is therefore insufficient to prevent subsequent settling and movement of the marker product following impacts or vibrations (for example during transport or while the ammunition is in the air), and this leads to a lack of uniformity of the distribution of the marker product, to an imbalance of the ammunition and to firing inaccuracies.

The problem addressed by the present invention is that of overcoming these drawbacks and, for this purpose, it relates to a device for practice ammunition which is capable of marking the point of impact of said ammunition by means of a marker product, said device being distinctive in that it comprises:

- an open housing in the form of a body of revolution which is capable of containing said marker product and comprises:
  - a convex conical base,
  - a cylindrical side wall and
  - internal partition walls arranged at least approximately radially starting from said cylindrical side wall and said conical base, while leaving the central summit portion thereof free,
- a removable stopper capable of sliding within said housing in the manner of a piston, and
- means for sealingly fixing said stopper in position in said housing.

Therefore, when filling the open housing with marker product, said product falls onto the central summit portion of the conical base and then slides on said base while evenly filling all the spaces in said housing between two consecutive partition walls. This therefore means that said housing is evenly filled. Said stopper then closes the housing and then presses the marker product towards the conical base to compact said marker product.

When the product has been compacted as desired owing to the action of said stopper acting as a piston, said stopper is fixed in position in said housing by said sealing fixing means, which are for example formed by a bead of adhesive or a similar material connecting the periphery of said stopper to the cylindrical side wall of the housing.

Therefore, owing to the present invention, the compactness of the marker product can be sufficiently controlled to prevent subsequent settling and movement within the ammunition and to achieve optimal dispersion of said marker product upon impact of said ammunition. The compacted marker product is therefore distributed evenly and in a stable manner within the ammunition, and this prevents an imbalance of the ammunition and firing inaccuracies, while allowing optimal marking of the point of impact.

It is noted that, owing to the optimal compactness of the marker product achieved by implementing the present invention, the volume of a dose of said marker product is reduced, so that the present invention can be used in low-calibre ammunition. In addition, the compactness of the marker product, together with said product being sealingly enclosed in the housing and stopper assembly, allows the ammunition provided with marker product to be stored for a long period of time.

It is also noted that said internal partition walls hold the compacted product in position, even in the case of external stresses, for example during logistical ammunition operations. To hold the product yet more securely, it is advantageous for said stopper to have projecting ribs on the surface thereof facing the inside of said housing. Therefore, when said marker product is compressed by said stopper, said projecting ribs press into said product and form grooves in which they are engaged.

Preferably, said projecting ribs are radial.

The present invention also relates to practice ammunition capable of marking the point of impact of said ammunition by means of a marker product, this ammunition being distinctive in that it comprises a marker device as set out above, which is fixed to said ammunition so that its axis of revolution coincides with the axis of said ammunition.

The figures of the accompanying drawings will make it easier to understand how the invention can be implemented. In these figures, identical reference numerals denote similar elements.

Figure 1:
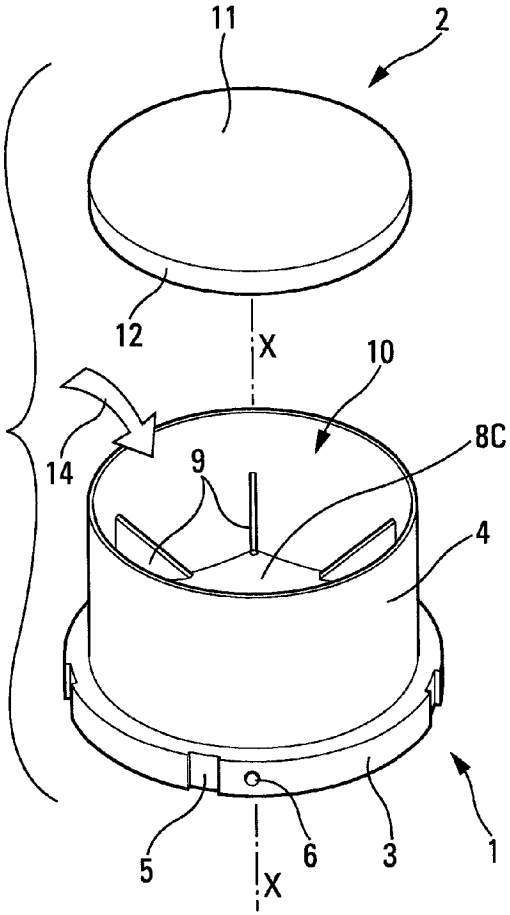
FIG. 1 is an exploded view of the housing and the stopper of the marker device for practice ammunition according to the present invention.

The two elements of the marker device according to the invention, as shown in FIG. 1, are formed by a housing 1 and its stopper 2.

Figure 2:
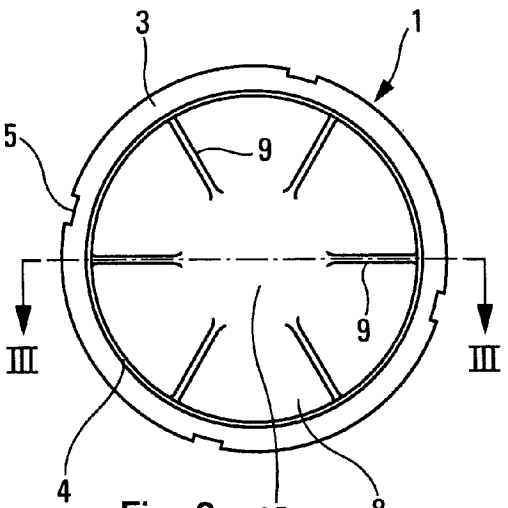
FIG. 2 is a plan view of said housing.
Figure 3:
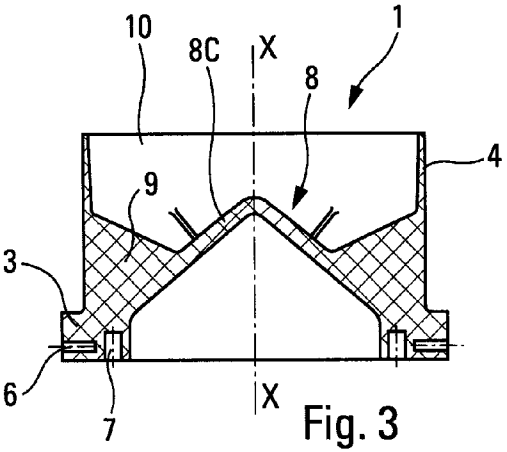
FIG. 3 is a cross section of said housing, along the diametral line III-Ill from FIG. 2.

As also shown in FIGS. 2 and 3, the housing 1 is generally cylindrical about the X-X axis and comprises a circular lower part having a cylindrical side wall 4. The periphery of the lower part 3 projects towards the outside relative to the side wall 4 and has elements 5, 6, 7 which are intended to be fixed to said housing 1 on a support (see FIG. 10). The central portion of the lower part 3 forms a base 8 for the housing 1, this base 8 having a convex conical shape projecting within said housing.

In addition, radial internal partition walls 9 which are arranged with regular spacing about the X-X axis are arranged between the side wall 4 and the inner peripheral part of the base 8.

Radial internal partition walls 9 of this type are substantially triangular and leave the central summit portion 8C of the base 8 free. Opposite the lower part 3 and the base 8, the housing 1 comprises an opening 10 which is delimited by the side wall 4.

Figure 4:
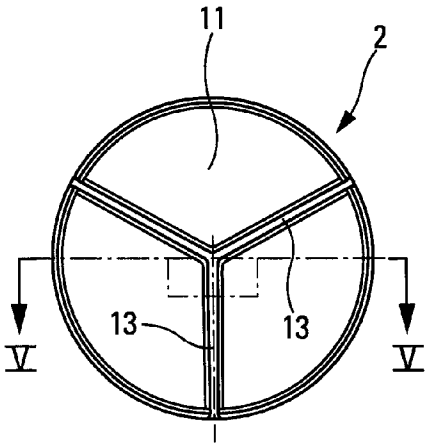
FIG. 4 is a bottom view of said stopper.
Figure 5:
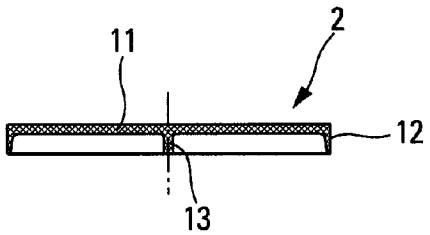
FIG. 5 is a cross section of said stopper, along the diametral line V-V from FIG. 4.
Figure 7:
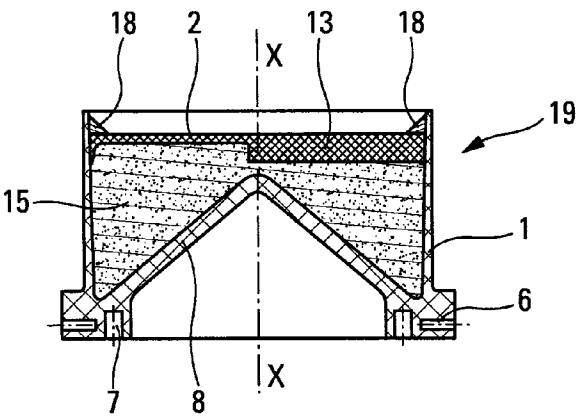
FIG. 7 is a diametral cross section of the marker device according to the present invention, after said housing has been filled with marker product, said product has been compressed by the stopper and said housing has been closed.

The stopper 2, shown in greater detail in FIGS. 4 and 5, is in the shape of a disc 11, its diameter being such that it can be inserted, transversely to the X-X axis, into the housing 1 through the opening 10 by sliding in the manner of a piston to seal said receptacle (see FIG. 7). For this purpose, said stopper 2 comprises a peripheral rim 12. It also comprises internal ribs 13 which are arranged radially and are intended to be directed towards the inside of the housing 1.

Figure 6:
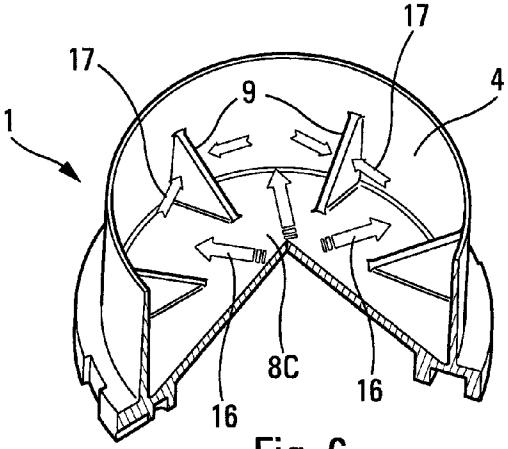
FIG. 6 shows, using a perspective view with part of the housing being cut away, the homogenous distribution of the marker product in said housing.

As schematically shown by the arrow 14 in FIG. 1, powdered or granular marker product is poured into the housing 1 onto the free central summit portion 8C of the conical base 8, so that said marker product slides thereon and is distributed between the partition walls 9. When the desired quantity of marker product has been poured into the housing 1, the stopper 2 is inserted through the opening 10 and is brought downwards towards said marker product. Pressure is exerted on said stopper 2 so that, in the manner of a piston, said stopper compacts said marker product. FIG. 6 shows that, owing to the axial pressure exerted by the stopper 2, said marker product is pressed so as to flow over the conical base 8 (arrows 16) and then to be distributed between the partition walls 9 (arrows 17).

Figure 9:
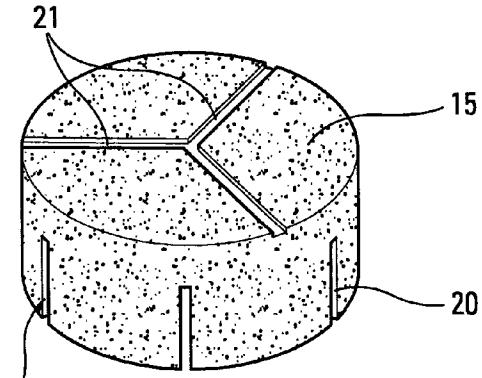
FIG. 9 is a perspective plan view of the shape that said compacted marker product takes within said housing.
Figure 8:
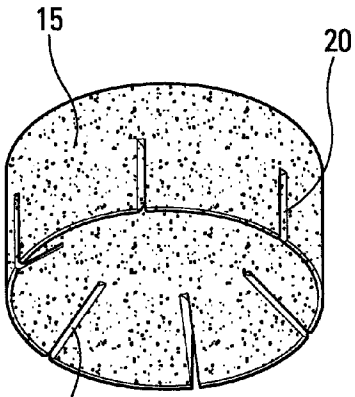
FIG. 8 is a perspective bottom view of the shape that said compacted marker product takes within said housing.

Once the desired compactness of the marker product has been obtained, pressure is no longer exerted on the stopper 2 and said stopper is fixed by a bead of adhesive 18 which connects the periphery of said stopper 2 to the side wall 4 of the housing 1 and ensures that the inside of said housing is sealed. The complete marker device 19 is thus obtained, as shown in FIG. 7, and has a shape of revolution about the X-X axis. This complete marker device 19 is thus formed by the housing 1, the stopper 2, the sealing fixing bead 18 and a compacted block 15 of marker product, held in place by the partition walls 9 of the housing 1 and by the ribs 13 of the stopper 2, which have formed each of the grooves 20 and 21 in which said ribs are positioned. FIGS. 8 and 9 show a block 15 of compacted marker product of this type, as if it had been removed from the assembly of the housing 1 and stopper 2.

Figure 10:
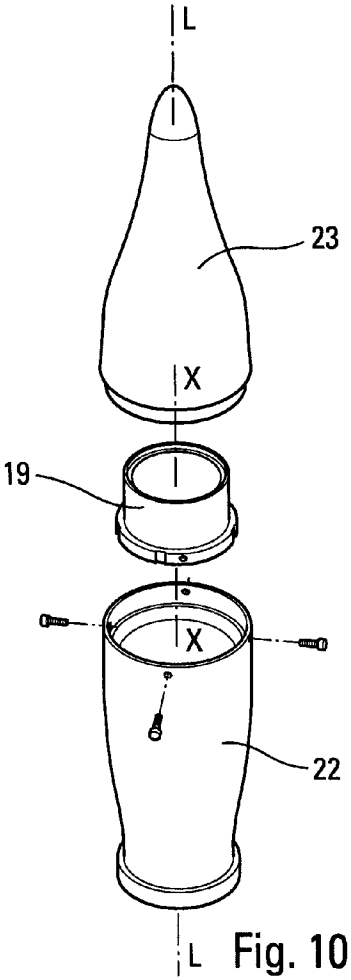
FIG. 10 is an exploded perspective view which shows the installation of the marker device according to the invention in the head of the practice ammunition.

As shown in FIG. 10, the marker device 19 thus obtained can then be integrated and fixed in the front part 22 of practice ammunition, so that its X-X axis coincides with the L-L axis of said ammunition, said front part 22 comprising a breakable nose 23 which covers said marker device 19.

The invention claimed is:

1. A device for practice ammunition, capable of marking the point of impact of said ammunition by means of a marker product, wherein said device comprises:

an open housing in the form of a body of revolution which is capable of containing said marker product and which comprises:

a convex conical base;

a cylindrical side wall; and internal partition walls arranged at least approximately radially starting from said cylindrical side wall and said conical base, while leaving the central summit portion thereof free;

a removable stopper capable of sliding within said housing in the manner of a piston; and means for sealingly fixing said stopper in position in said housing.

2. The device according to claim 1, wherein said means for sealingly fixing said stopper in said housing consist of beads of an adhesive material connecting the periphery of said stopper to the cylindrical side wall of said housing.

3. The device according to claim 1, wherein said stopper comprises projecting internal ribs on its surface facing the inside of said housing.

4. The device according to claim 3, wherein said protruding ribs are radial.

5. A practice ammunition capable of marking the point of impact of said ammunition by means of a marker product, wherein said practice ammunition comprises a marker device as specified in claim 1, fixed to said ammunition in such a way that its axis of revolution (X-X) coincides with the axis (L-L) of said ammunition.

* * * * *